US006273788B1

(12) United States Patent
Shaw

(10) Patent No.: US 6,273,788 B1
(45) Date of Patent: Aug. 14, 2001

(54) SUSTAINED SURFACE SCRUBBING

(75) Inventor: James S. Shaw, Hampton Falls, NH (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/358,643

(22) Filed: Jul. 23, 1999

(51) Int. Cl.[7] ..... B24C 1/00

(52) U.S. Cl. ..... 451/38; 451/39; 451/66; 451/103

(58) Field of Search ..... 451/38, 39, 66, 451/103

(56) References Cited

U.S. PATENT DOCUMENTS

| | | | | |
|---|---|---|---|---|
| 5,146,716 | | 9/1992 | Lynn . | |
| 5,207,034 | | 5/1993 | Lynn . | |
| 5,234,470 | | 8/1993 | Lynn . | |
| 5,247,766 | | 9/1993 | Kildea | 51/317 |
| 5,279,075 | | 1/1994 | Sage et al. | 51/165.71 |
| 5,766,368 | * | 6/1998 | Bowers | 451/38 |
| 5,810,644 | * | 9/1998 | Schmidt | 451/38 |
| 5,910,338 | * | 6/1999 | Donde | 451/38 |
| 5,964,644 | * | 10/1999 | Rhoades | 451/39 |

FOREIGN PATENT DOCUMENTS

| | | |
|---|---|---|
| 0178164 | 4/1986 | (EP) . |
| 0430856 | 6/1991 | (EP) . |

OTHER PUBLICATIONS

U.S. application No. 09/379,918, Shaw, filed Aug. 24, 1999.
U.S. application No. 09/379,917, Shaw, filed Aug. 24, 1999.
US Patent application Ser. No. 09/217,672 filed Dec. 21, 1998, entitled "Free Flow Abrasive Hole Polishing," Inventor: James S. Shaw, General Electric Company assignee.
Sponge–Jet, Inc., "Sponge Blasting System," brochure, 1997.
Sponge–Jet, Inc, "Material Safety Data Sheets," Aug. 30, 1996.
Sponge–Jet, Inc. "Case Histories," undated.

* cited by examiner

*Primary Examiner*—M. Rachuba
(74) *Attorney, Agent, or Firm*—Andrew C. Hess; Gerry S. Gressel

(57) ABSTRACT

The surface of a workpiece is treated by discharging a stream of pliant shot in a carrier fluid at a shallow angle of incidence thereagainst. The shot is then scrubbed laterally along the surface for selectively removing target material therefrom.

24 Claims, 4 Drawing Sheets

SUSTAINED SURFACE SCRUBBING

BACKGROUND OF THE INVENTION

The present invention relates generally to manufacture and repair of machine parts, and, more specifically, to surface finishing of such parts.

Machines are assemblies of various parts which are individually manufactured and assembled. Machines typically include metal parts, although synthetic and composite parts may also be used. And, each part requires specialized manufacturing.

For example, metal parts may be fabricated from metal stock in the form of sheets, plates, bars, and rods. Metal parts may also be formed by casting or forging. Such parts may be machined to shape in various manners.

Machining requires the selective removal of material to configure the part to its final shape and size within suitable manufacturing tolerances, typically expressed in mils, and with a suitable surface finish which is typically smooth or polished without blemish.

Each step in the manufacturing process of a given machine adds time and expense which should be minimized for producing a competitively priced product. It is desirable for each subsequent step in the manufacturing process to avoid damaging previously finished portions of the part which would then require additional corrective finishing steps.

Gas turbine engines are an example of a complex machine having many parts requiring precise manufacturing tolerances and fine surface finishes. A typical engine includes a multistage compressor for pressurizing air which is mixed with fuel in a combustor and ignited for generating hot combustion gases which flow downstream through one or more turbine stages that extract energy therefrom. A high pressure turbine powers the compressor, and a low pressure turbine provides output power, such as powering a fan disposed upstream from the compressor in an aircraft engine application.

The engine thusly includes various stationary components, and various rotating components which are typically formed of high strength, state of the art metal and composite materials. The various parts undergo several steps in their manufacturing and are relatively expensive to produce.

Since the combustor of the engine must contain hot combustion gases during operation, it is formed of high strength superalloy material for maintaining strength at high temperature. An annular combustor includes radially outer and inner combustion liners which are joined together at upstream ends thereof to an annular dome. The dome includes a plurality of circumferentially spaced apart carburetors that inject fuel and air into the combustor, which is then ignited for generating the hot combustion gases contained in the combustor.

The combustor is cooled during operation by channeling a portion of compressor air through many film cooling holes extending through the liners in dense patterns for producing protective films of cooling air along the inboard surfaces thereof exposed to the hot combustion gases.

During the manufacturing process, the individual combustion liners are formed in rings which are assembled and joined together with the annular dome. The film cooling holes in the liners may be formed or drilled therethrough in various manners. It is common to laser drill small film cooling holes at an acute angle through the respective liners.

However, laser drilling results in expulsion of molten metal from the holes as they are drilled. Some of the laser expulsion becomes welded to the surface of the liner in the form of small bumps thereatop. And, some of the laser expulsion becomes welded to the inlet and outlet perimeters of the holes where they meet the outer and inner surfaces of the liner.

Prior to laser drilling, the liner surfaces are in finished form, which is highly smooth. The laser expulsion welded to the liner surfaces and to the inlets or outlets of the film cooling holes is undesirable since it adversely affects performance thereof.

Accordingly, an additional process is required for removing the laser expulsion from the liner surfaces and the holes. And, the perimeter corners of the holes where they meet the liner surfaces are preferably radiused for removing the sharp edges thereof and reducing stress concentrations thereat.

Grit blasting is a process in which abrasive particles are discharged in an air stream for abrading a metal surface. This process is quite abrasive and requires close control. A related process uses both air and water as the carrier stream for the abrasive grit and has been used to remove laser expulsion and radius the film cooling holes for a combustor liner.

However, this process requires a significant expenditure of time for removing the laser expulsion over thousands of small film cooling holes in a typical combustion liner, and requires expensive equipment therefor. The cost of the liner must correspondingly increase. And, this process has limited capability for radiusing the film cooling holes without adversely affecting surface finish of the liner, or wall thickness thereof.

Since the grit stream necessarily covers many small film cooling holes and liner surface therebetween, care must be used to minimize degradation of the finish of the liner surface between the holes during the removal of laser expulsion.

Accordingly, it is desired to provide an improved process for surface treating a workpiece, having little or no adverse effect on surface finish thereof.

BRIEF SUMMARY OF THE INVENTION

The surface of a workpiece is treated by discharging a stream of pliant shot in a carrier fluid at a shallow angle of incidence thereagainst. The shot is then scrubbed laterally along the surface for selectively removing target material therefrom.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
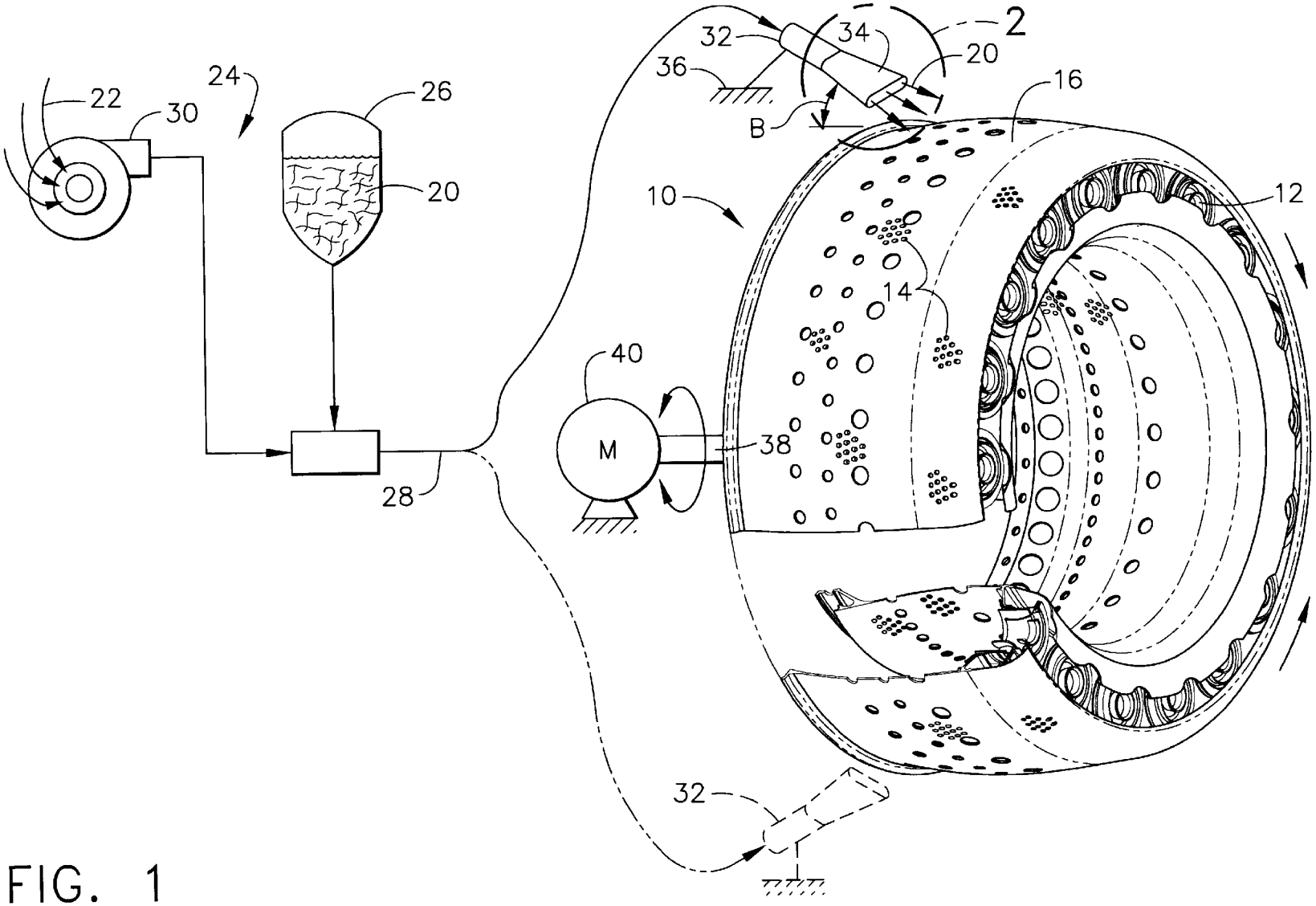
FIG. 1 is a schematic representation of a method for surface treating a workpiece, such as an annular combustor, in accordance with an exemplary embodiment of the present invention.

Illustrated in FIG. 1 is a workpiece 10 in the exemplary form of a liner of an annular gas turbine engine combustor. The workpiece is formed of metal, although other workpieces of different configurations may be used and formed of different materials, such as composites, for example.

The combustor may have any conventional configuration and typically includes radially outer and inner annular liners joined together at upstream ends at an annular dome. A plurality of circumferentially spaced apart air swirlers 12 are suitably mounted in the combustor dome, and receive fuel injections (not shown) which inject fuel into the combustor for mixing with air for generating hot combustion gases during operation.

The combustor is cooled during operation in a conventional manner by channeling air from the engine compressor through film cooling holes 14 densely distributed over the entire annular surfaces of both combustor liners.

Figure 2:
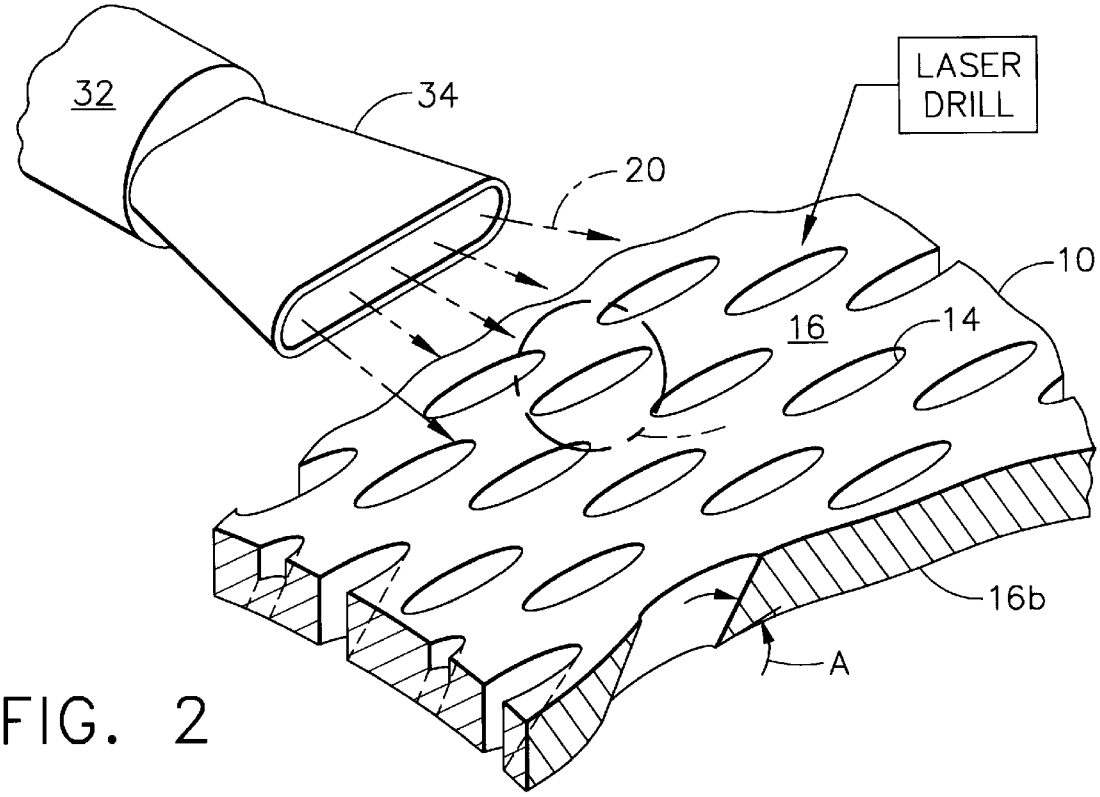
FIG. 2 is an enlarged, partly sectional view, of a portion of one of the combustion liners illustrated in FIG. 1, within the circle labeled 2, being subjected to sustained surface scrubbing in accordance with an exemplary embodiment of the present invention.

FIG. 2 illustrates a portion of the outer liner 10 of the combustor including many film cooling holes 14 extending therethrough in a dense, multi-hole pattern of conventional configuration. In one exemplary manufacturing process, the individual holes 14 are formed through the liner by laser drilling.

Each hole 14 is inclined through the liner at an acute inclination angle A, of about 15° for example. The hole extends from the exposed, outer surface 16 of the liner to the opposite inner surface 16*b*, and is inclined in the downstream air direction so that cooling air channeled over the outer surface 16 enters the outboard inlet side thereof and continues to flow in the axial downstream direction for discharge from the inboard outlet side along the liner inner surface for providing film cooling thereof. In FIG. 2, the cooling air flow is from right to left.

Since the holes 14 are generally cylindrical, they effect oval profiles at their inlets where they meet the outer surface 16 and at their outlets where they meet the inner surface 16*b*.

As indicated above, laser drilling of the liner removes parent material thereof to form the individual holes 14. An enlarged view of one of the holes 14 is illustrated in more detail in FIG. 3.

Some of the laser expulsion from the drilled holes is redeposited or welded atop the liner surface 16 as small bumps 18*a* which protrude outwardly from corresponding portions of the surface, leaving the remainder of the surface unaffected for maintaining its original smooth surface finish. Some of the laser expulsion also becomes attached or welded as a ridge 18*b* around the entrance of each hole.

Figure 3:
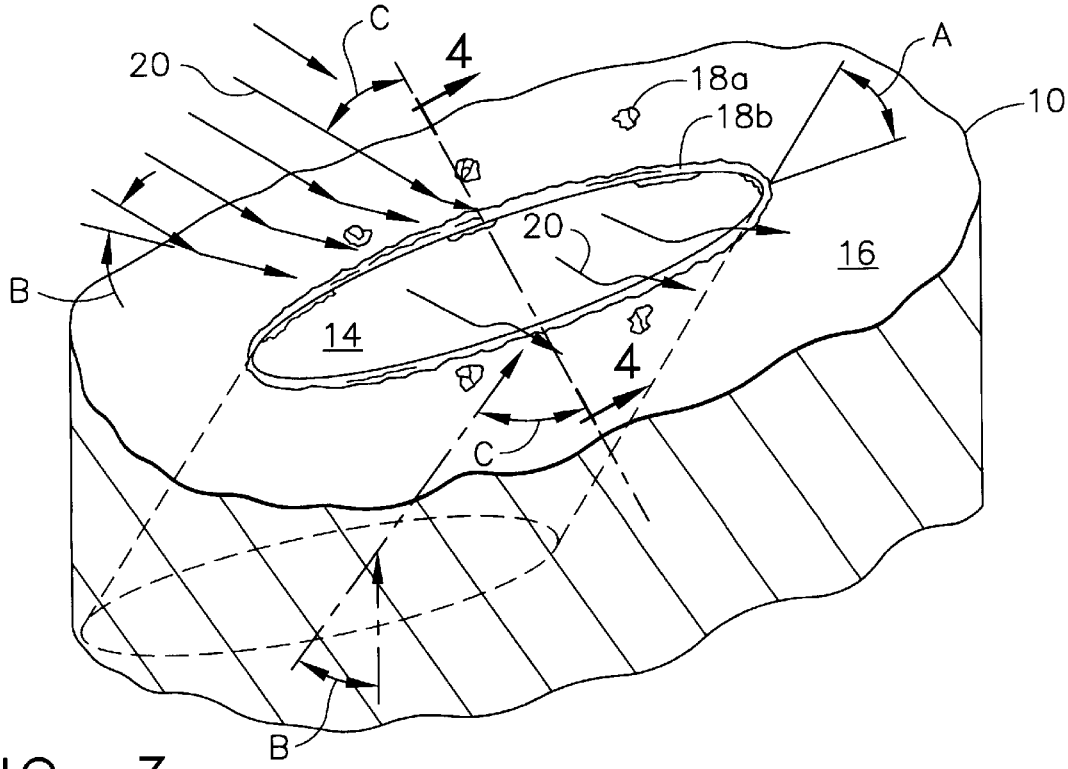
FIG. 3 is a further enlarged, partly sectional view of an exemplary one of the holes through the liner illustrated in FIG. 2 within the circle labeled 3 showing surface scrubbing thereof.
Figure 4:
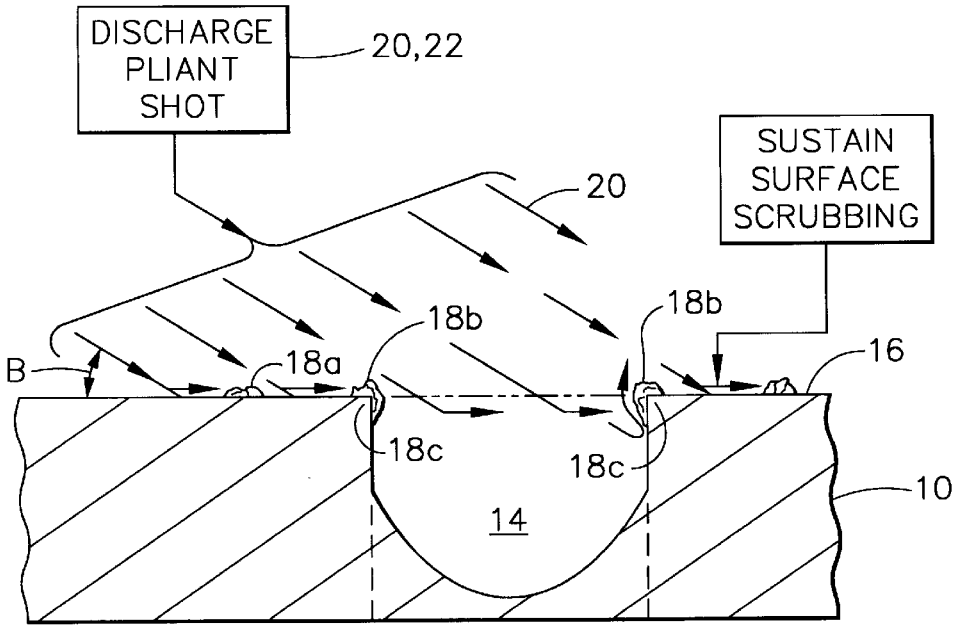
FIG. 4 is a partly sectional view through the liner portion illustrated in FIG. 3 and taken along line 4—4.

FIG. 3 illustrates the oval inlet of the film cooling hole 14 having the laser expulsion ridge 18*b* welded around most of the perimeter thereof. As shown in FIG. 4, the perimeter of the hole at its entrance in the outer surface 16 includes a corner 18*c* which adjoins the liner outer surface 16 on one side and adjoins the inner surface of the hole 14 on its other side. The ridge 18*b* is typically welded atop some or all of the inlet corner 18*c* during laser drilling.

Accordingly, the laser expulsion 18*a,b* illustrated in exemplary embodiments in FIGS. 3 and 4 provides undesirable protrusions from the desired profiles of the film cooling holes and the desired smooth finish of the liner surface 16. As indicated above, conventional practice uses air/water assisted grit blasting for removing the laser expulsion at significant cost and requires significant care for reducing material removal on the finished surface 16.

In accordance with the present invention, laser expulsion may be quickly and safely removed from the laser drilled combustion liner using a new method of surface treatment illustrated schematically in FIG. 1. The surface 16 of the liner is treated by discharging or ejecting a stream of pliant or soft shot 20 in a carrier fluid 22, such as air, at a shallow angle of incidence B against the liner surface 16. The pliant shot and shallow surface angle B cause scrubbing of the shot laterally along the surface 16 for selectively removing target material from the liner surface. As disclosed in more detail hereinbelow, the target may include the laser expulsion in the form of the bumps 18*a* or hole ridges 18*b*, or may even include the hole corners 18*c* themselves for radiusing thereof.

The target material to be removed may be in various forms that adjoin the surface 16 which undergoes scrubbing for selectively removing the target material while providing little or no damage to the finish of the surface itself. In the Sustained Surface Scrubbing ($S^3$) process of the present invention, the shot 20 scrubs both the surface and the target for selectively removing the target distinctly from the adjoining surface 16.

The various targets 18*a,b,c* illustrated in FIG. 4, for example, define discontinuities along the surface of the liner which are instrumental in their removal while protecting the smooth surface 16 itself. The shot 20 is directed at the liner surface 16 at the shallow angle of incidence B within the carrier fluid 22. The shot 20 is pliant and resilient, and initially compresses as it impacts the liner surface with little or no rebounding in the region of the impact site. The shallow incidence angle B ensures that the shot is scrubbed generally parallel to the surface 16 for the protection thereof, while then traveling in impingement against the protruding target for removal thereof.

Figure 5:
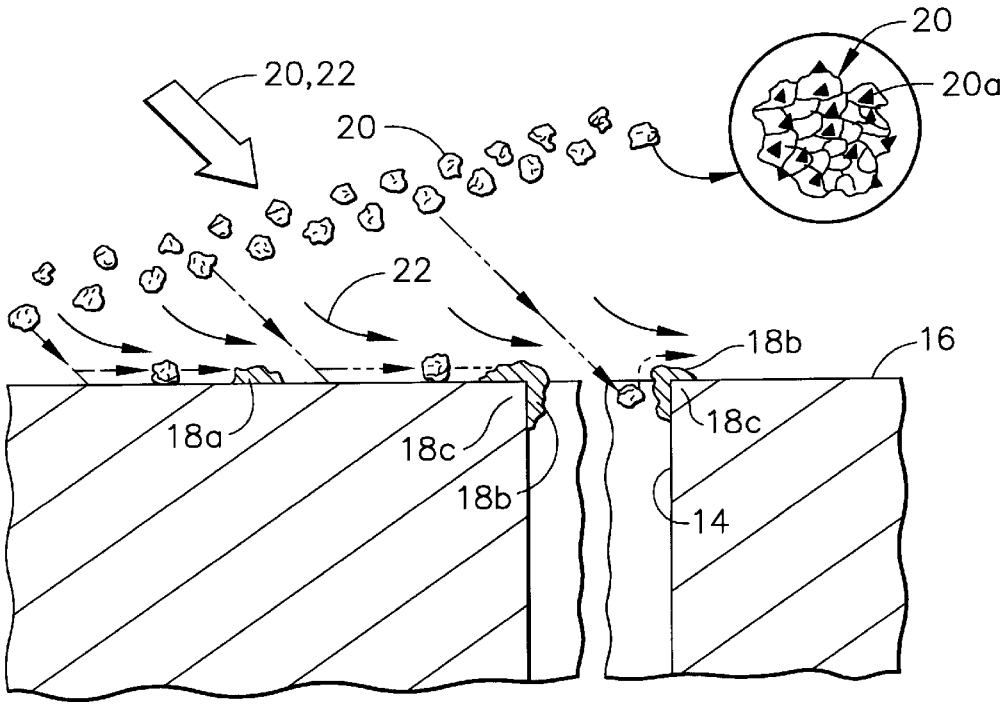
FIG. 5 is a further enlarged sectional view of the liner portion illustrated in FIG. 4 illustrating surface scrubbing around the hole therein in a first direction.

As shown in greater magnification in FIG. 5, the stream of shot 20 impacts the liner surface over the corresponding impact site including one or more of the holes 14 and surrounding surface 16. The pliant shot compress as they engage the surface 16 and travel parallel therealong due to their kinetic energy, as well as the blanket of carrier fluid 22 which flows thereover. In this way, the sustained surface scrubbing effect is maintained by the stream of shot for a finite distance along the liner surface with little or no appreciable rebounding therefrom.

In the preferred embodiment illustrated in FIG. 5, the shot 20 comprise a light-weight, resilient material such as sponge, rubber, felt, plastic, foam, or other resilient material. The shot may have open or closed cells. The shot 20 preferably includes abrasive particles 20*a* imbedded therein, although in alternate embodiments abrasive may be omitted. Suitable abrasives include particles of various minerals, metal oxides, plastics, and black walnut shell, for example.

One type of suitable pliant shot is commercially available from Sponge-Jet Inc. of Eliot, Maine under the tradename of Sponge Media. This sponge media includes a polyurethane open-cell carrier in which is impregnated different types of abrasive material for different abrasive performance. And, one form of the sponge media is without abrasive.

Equipment for discharging the pliant shot is also commercially available from Sponge-Jet Inc., but is modified and operated differently for purposes of the sustained surface scrubbing of the present invention. In conventional practice, the sponge media is blasted perpendicularly, or close thereto, against a surface of a workpiece for removing coatings thereof while profiling the underlying surface. Accordingly, impingement of the sponge media not only removes coatings atop the surface, but also removes underlying material of the surface itself which changes its surface finish.

As indicated above, the combustor liner 10, as an exemplary workpiece, typically has a finished surface which is preferably protected when removing the target material therefrom. Since the target material in the exemplary embodiment disclosed above is laser expulsion welded to the liner surface, the target material is the same as the underlying surface material, and suitable discrimination therebetween is required to prevent damage to the surface.

Accordingly, FIG. 1 illustrates a conventional blasting apparatus 24, commercially available from Sponge-Jet Inc., which is modified in accordance with the present invention for use in achieving sustained surface scrubbing. The apparatus 24 includes a hopper 26 in which the pliant shot 20 is stored. The hopper 26 is joined in flow communication with a delivery conduit 28 through which the shot 20 is discharged.

An air compressor or pump 30 is operatively joined to the delivery conduit 28 for providing air as the carrier fluid 22 under suitable pressure for carrying and discharging the shot in a stream through a suitable nozzle 32. In accordance with one feature of the present invention, the nozzle 32 is modified to include an oval fan tip 34 for laterally spreading the shot stream 20 therefrom for providing increased surface coverage. And, low air pressure of about 30–40 psi is preferred to discharge a uniform dispersion of shot.

The nozzle 32 illustrated in FIG. 1 is preferably fixedly mounted to a suitable stationary support 36, and aimed or directed at the desired surface of the liner for undergoing scrubbing. The combustor liner 10 is suitably mounted upon a spindle or arbor 38 joined to a suitable motor 40 for rotating the liner relative to the nozzle 32. In this exemplary configuration, the nozzle 32 may be directed generally tangentially to the liner surface 16 for performing surface scrubbing thereof.

FIG. 1 illustrates schematically the assembled combustor including its outer and inner liners, dome, and air swirlers. However, it is preferred to scrub each of the liners prior to assembly in the combustor so that both surfaces of each liner may be scrubbed without obstruction.

As shown in more detail in FIG. 4, the nozzle is oriented relative to the liner surface 16 for discharging the shot 20 at the shallow incidence angle B. In one embodiment tested, the incidence angle B was 30°, and the shot was observed as maintaining scrubbing contact on the liner surface without appreciable rebound for at least several centimeters. Sustained surface scrubbing was also obtained at an incidence angle B of up to about 45°.

The incidence angle B may be varied along with the operating air pressure of the delivery apparatus 24 and the type of pliant shot used, and may range up to about 60°, for example. The limit on the incidence angle B is that angle at which the shot experiences rebounding off the surface at the impact site with a corresponding loss in lateral or sustained scrubbing thereof. And, shallow incidence angles should be used to prevent the abrasive from imbedding in the surface.

Impingement of the shot causing rebounding thereof is undesirable since the material-removal performance of the shot then occurs in similar amounts over the target material as well as the adjoining liner surface within the impact site. And, normal to the surface impingement of abrasives is undesirable since the abrasive may become imbedded in the workpiece surface.

In contrast, sustained surface scrubbing carries the shot 22 generally parallel along the surface of the liner with little or no material removal therefrom, while laterally impinging the various forms of targets which protrude from the surface. The target protrusions are readily removed by the shot without significantly affecting the liner surface, and, in particular, maintaining the smooth finish thereof.

Of particular importance in forming the inclined film cooling holes illustrated in FIG. 3 is not only removing laser expulsion around the perimeter of the hole where it meets the liner surface, but also forming a preferred radius along the perimeter to eliminate sharp edges which could otherwise introduce undesirable stress concentrations or interfere with smooth flow of the cooling air through the holes.

Accordingly, in a preferred embodiment, the shot stream 20 is firstly directed obliquely at a side or target angle C toward the leeward first side of the hole first receiving the shot for radiusing the corner target 18*b,c* along the windward second side of the hole which is opposite to the first side relative to the major axis of the oval perimeter.

As shown in more detail in FIGS. 4 and 5, the shot 20 is thusly scrubbed over the hole in a first direction to impinge the corner target 18*b,c* along the second side of the hole for radiusing thereof. In this way, not only are the target bumps 18*a* on the liner surface removed by lateral scrubbing, but the target ridges 18*b* along the lateral path of the shot are abraded down to the liner surface. And, any target ridge 18*b* on the second, downstream side of the shot is abraded, with the underlying corner 18*c* also being abraded to form a smooth and well defined radius.

Figure 6:
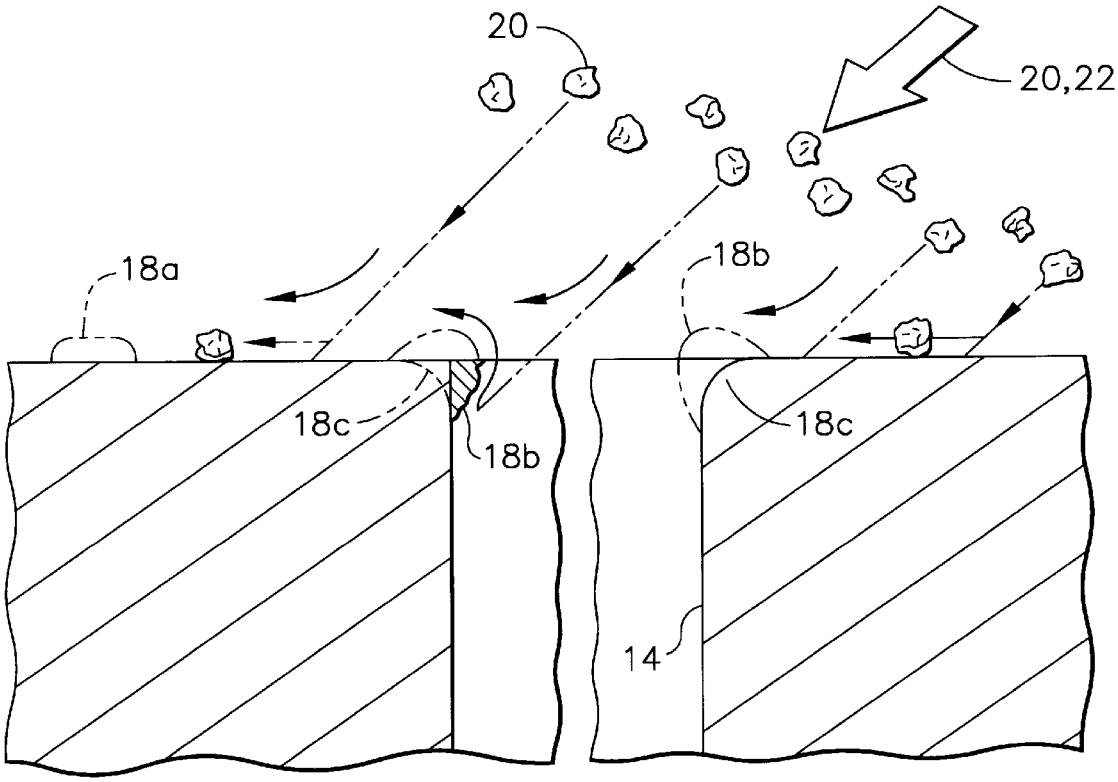
FIG. 6 is an enlarged sectional view, like FIG. 5, showing surface scrubbing of the hole in an opposite direction.

FIG. 6 illustrates an exemplary one of the holes 14 after scrubbing in the first direction, with a portion of the target ridge 18*b* below the surface of the liner remaining since it was hidden within the shadow of the laterally scrubbing shot illustrated in FIG. 5. The initially removed target bumps and the exposed portions of the first side ridges 18*b* are shown in phantom line.

As shown in FIG. 6, the shot stream is then re-directed obliquely toward the second side of the hole 14 for radiusing the remaining corner target 18*b,c* along the opposite first side of the hole. In this way, the shot 20 is scrubbed in an opposite, second direction over the hole 14 to impinge the corner target 18*b,c* along the opposite, first side of the hole for final radiusing thereof. The final radiused corner along the hole first side is shown in dashed line.

As shown in FIG. 3, the shot 20 is directed at the liner surface at the shallow surface angle B, as well as being preferably directly obliquely at the target angle C for directionally targeting the ridges 18*b* on opposite sides of the holes. As shown in solid line in FIG. 3, the shot 20 is oriented initially on one side of the hole which may be effected by mounting the nozzle 32 generally tangentially to the perimeter of the combustor liner as illustrated in FIG. 1.

As shown in phantom line in FIG. 3, the shot 20 is then re-directed to an equal but opposite side angle C on the opposite side of the hole for removing the ridge and radiusing the opposite side of the hole perimeter. This may be effected by remounting the nozzle 32 illustrated in FIG. 1 in an opposite direction generally tangentially to the perimeter of the liner.

Accordingly, any surface irregularity or discontinuity protruding into the path of the shot is locally abraded, while parallel surfaces are protected. The scrubbing shot is thusly effective for scrubbing and removing by impingement the bumps 18*a* and outward protrusions of the target ridges 18*b*, as well as the inward protrusions of the ridges on the downstream side of the holes relative to the travel direction of the shot.

Although the side angle C may be 90° to direct the shot generally perpendicular to the opposite side of the hole, this angle is preferably oblique with the two sides of the hole for respective scrubbing thereof in turn. The side angle C is preferably less than 90°, and may be with the range of about 45°–80°, for example.

As shown in FIG. 3, the hole 14 is inclined through the liner 10 and creates the oval hole profile at the surface. The shot stream is preferably directed toward the hole at an acute spread angle therewith for self-purging or cleaning the shot therefrom during operation. As the shot encounters the inclined hole as illustrated in FIGS. 3–5, it will thusly tend to be driven out of the hole instead of accumulating therein. The predominant travel direction of the shot prevents it from reversing direction upstream on itself.

This is in contrast to directing the shot in an opposite direction to that shown in FIG. 3, wherein the shot would form an obtuse spread angle therewith, and readily enter and accumulate inside the hole.

As shown in FIGS. 1 and 2, the film cooling holes 14 are laterally spaced apart from each other over the exposed liner surface 16 in any conventional multi-hole pattern, which is typically dense with many holes per square centimeter. To maximize the speed of the shot scrubbing process, the shot stream is preferably spread across the liner surface using the exemplary oval-shaped fan tip 34 for scrubbing and impinging all targets within its scrubbing area.

As indicated above, the various targets, including the laser expulsion bumps 18*a* and the hole ridges 18*b*, which protrude outwardly from the liner surface, are thusly within the lateral impingement path of the shot which effectively abrades and removes the outward protrusions thereof by the lateral scrubbing action.

The scrubbing process may be automated by mounting the combustor liner 10 on the arbor 38 joined to the motor 40 for rotating the liner in opposite clockwise or counterclockwise directions in turn. In this way, the nozzle 32 may be suitably positioned generally tangentially to the outer or inner combustor liner, with the liner then being rotated as scrubbing is effected. The relative velocity between the shot and rotating surface should be limited to prevent undesirable rebounding of the shot therefrom.

The nozzle may be traversed as required over the full axial extent of the combustor for scrubbing clean the exposed outboard and inboard surfaces of the combustor liners subject to laser expulsion accretion. And, the laser expulsion is also scrubbed from the hole corners, which are then suitably radiused by the shot treatment thereof.

Sustained surface scrubbing therefore removes the laser expulsion from the combustor liners, and also provides suitable radiusing around the perimeter of the holes where they meet the exposed liner surface. And, sustained surface scrubbing accomplishes laser expulsion removal without changing or removing the finish of the liner surface itself, except directly where the targets are removed. The scrubbing action of the shot over the liner surface has little, if any, perceptible effect thereon, except for selectively removing the laser expulsion thereon, and within the film cooling holes.

As indicated above, the pliant shot 20 may have any suitable configuration and composition for eliminating or reducing the likelihood of shot rebound from the workpiece surface when discharged thereat at the shallow incidence angle. The pliant shot in most applications will include a suitable abrasive which may take any conventional form as required for abrading foreign protrusions on the workpiece, as well as abrading the parent material at discontinuities in the workpiece, such as the corners of the film cooling holes.

The pliant shot may even be used without abrasive particles therein for removing from the workpiece surface masking tapes, for example, which are otherwise difficult to remove due to the typical adhesives provided. The tape may be cleanly removed from the surface without affecting the finish of the surface itself.

Sustained surface scrubbing in accordance with the invention described above may be used in various applications besides those described. Such scrubbing is selective or preferential, and is effective for locally removing material at discontinuities in the surface over which the shot travels generally parallel thereto. The scrubbing process may be used with particular advantage in various final manufacturing steps in producing parts without adversely affecting part finish previously prepared.

In the gas turbine engine combustor liner example described above, the multiple film cooling holes are scrubbed in a preferred manner for maintaining liner surface finish while simultaneously removing laser expulsion and radiusing both the inlet and outlet ends of the film cooling holes. Other gas turbine engine parts may also enjoy the benefit of sustained surface scrubbing, as specifically configured for the disparate requirements thereof.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which I claim:

1. A method of treating a surface of a workpiece comprising:

discharging a stream of pliant shot in a carrier fluid at a shallow angle of incidence against said surface; and scrubbing said shot laterally along said surface for selectively removing target material therefrom.

2. A method according to claim 1 wherein:

said target adjoins said surface; and said shot scrubs said target for selective removal thereof distinctly from said adjoining surface.

3. A method according to claim 2 wherein:

said target defines a discontinuity along said surface; and said shot is scrubbed parallel to said surface for protection thereof, and in impingement against said target for removal thereof.

4. A method according to claim 3 wherein:

said target defines a bump disposed atop a portion of said surface and protruding outwardly therefrom; and said shot is scrubbed over said surface to impinge said target bump for removal thereof from said surface.

5. A method according to claim 3 wherein said workpiece includes a hole therein extending through said surface, and said hole has a perimeter corner adjoining said surface to define said target; and said shot is scrubbed over said surface to impinge said target corner for radiusing thereof.

6. A method according to claim 5 wherein said shot is scrubbed over said hole in a first direction to impinge said corner target along a second side of said hole for radiusing thereof.

7. A method according to claim 6 wherein said shot is scrubbed in an opposite, second direction over said hole to impinge said corner target along an opposite, first side of said hole for radiusing thereof.

8. A method according to claim 5 wherein said corner target protrudes outwardly from said surface, and said shot is scrubbed in impingement thereagainst to remove said outward protrusion thereof.

9. A method according to claim 5 wherein said corner target protrudes inwardly into said hole, and said shot is scrubbed in impingement thereagainst to remove said inward protrusion thereof.

10. A method according to claim 5 wherein:

said hole is inclined through said workpiece to effect an oval profile at said surface, and includes opposite, first and second sides bounding a major axis thereof; and said shot stream is directed obliquely toward said first and second sides of said hole.

11. A method according to claim 10 wherein:

said shot stream is directed obliquely toward said first side of said hole for radiusing said corner target along said second side of said hole; and said shot is then re-directed obliquely toward said second side of said hole for radiusing said corner target along said first side of said hole.

12. A method according to claim 10 wherein said shot stream is directed toward said hole at an acute spread angle therewith for self-purging therefrom.

13. A method according to claim 5 wherein:

said workpiece includes a plurality of said holes laterally spaced apart from each other over said surface; and said shot stream is spread across said surface for impinging corresponding corner targets thereof.

14. A method according to claim 13 wherein said workpiece comprises a gas turbine engine combustor liner including a plurality of film cooling holes therethrough defining a plurality of said corner targets.

15. A method according to claim 14 further comprising:

laser drilling said film cooling holes through said liner 10 to form said corner targets including laser expulsion therein; and scrubbing said liner surface and corner targets to remove said laser expulsion.

16. A method according to claim 15 further comprising scrubbing said liner surface and said corner targets for radiusing said targets.

17. A method according to claim 16 further comprising scrubbing said liner surface and said corner targets without changing finish of said surface.

18. A method according to claim 5 wherein said shot comprises open-cell sponge.

19. A method according to claim 18 wherein said shot further comprises abrasive particles imbedded therein.

20. A method according to claim 19 wherein said sponge shot comprises polyurethane.

21. A method of treating a surface of a workpiece having a discontinuity adjoining said surface to define a target, comprising:

discharging a stream of pliant shot in a carrier fluid at a shallow angle of incidence against said surface; and scrubbing said shot along said surface for selectively removing said target adjoining said surface.

22. A method according to claim 21 wherein said shot is scrubbed parallel to said surface for protection thereof, and in impingement against said target for removal thereof.

23. A method according to claim 22 wherein said workpiece includes a hole therein extending through said surface, and said hole has a perimeter corner adjoining said surface to define said target; and said shot is scrubbed over said surface to impinge said target corner for radiusing thereof.

24. A method of treating a surface of a gas turbine engine combustor liner comprising:

laser drilling a plurality of film cooling holes through said liner to define a plurality of corner targets including laser expulsion therein;

discharging a stream of pliant shot in a carrier fluid at a shallow angle of incidence against said surface; and scrubbing said shot parallel to and along said surface and in impingement against said corner targets for selectively removing said laser expulsion therefrom and radiusing thereof.

* * * * *